US011946724B2

(12) United States Patent
Gerber et al.

(10) Patent No.: US 11,946,724 B2
(45) **Date of Patent: *Apr. 2, 2024**

(54) FIREARM OPTIC ASSEMBLY

(71) Applicant: Martin James Bordson, Kansas City, MO (US)

(72) Inventors: Jordan Christopher Gerber, Savannah, MO (US); Anatoly Grushansky, Overland Park, KS (US)

(73) Assignee: Martin James Bordson, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/120,368

(22) Filed: Mar. 11, 2023

(65) Prior Publication Data

US 2023/0228533 A1 Jul. 20, 2023

Related U.S. Application Data

(63) Continuation of application No. 17/745,944, filed on May 17, 2022, now abandoned, which is a (Continued)

(51) Int. Cl.
*F41G 11/00* (2006.01)
*F41G 1/35* (2006.01)
*F41G 1/38* (2006.01)

(52) U.S. Cl.
CPC ..... *F41G 11/003* (2013.01); *F41G 1/35* (2013.01); *F41G 1/38* (2013.01)

(58) Field of Classification Search
CPC ..... F41G 11/003; F41G 1/35; F41G 1/38
See application file for complete search history.

(56) References Cited

U.S. PATENT DOCUMENTS 3,737,232 A * 6/1973 Milburn, Jr. ..... G02B 23/14 356/18
3,880,389 A * 4/1975 Burris ..... F41G 11/006 D22/109

(Continued)

OTHER PUBLICATIONS

Badger Ordnance Condition One Modular Mounts (http://web.archive.org/web/20191031145814/https://www.brownells.com/optics-mounting/rings-mounts-amp-bases/mount-sets/condition-one-modular-mounts-prod128657.aspx) (Year: 2019).*

(Continued)

*Primary Examiner* — Michelle Clement
(74) *Attorney, Agent, or Firm* — Bennet K. Langlotz; Langlotz Patent & Trademark Works, LLC

(57) ABSTRACT

A firearm optic assembly has a body, the body having a first mounting facility configured to removably connect the body to the firearm, the body having a first receptacle configured to receive a first accessory, the body having a second mounting facility configured to removably receive a second mount portion associated with a second accessory offset from the medial plane, the second mounting facility including a pocket defined by one of the body and the second mount portion, the second mounting facility including a protrusion on the other of the body and the second mount portion, the protrusion being configured to be slidably or loosely received in the pocket, the protrusion having a free end and an opposed base end, the second mounting facility having an alignment facility including flared surfaces at the base end, and the flared surfaces being on opposing sides of the protrusion.

13 Claims, 4 Drawing Sheets

Related U.S. Application Data continuation of application No. 16/990,615, filed on Aug. 11, 2020, now Pat. No. 11,365,954.

(60) Provisional application No. 63/048,218, filed on Jul. 6, 2020.

(56) References Cited

U.S. PATENT DOCUMENTS 3,992,783 A * 11/1976 Dunlap ..... F41G 11/003 42/124
4,841,659 A * 6/1989 Williams ..... F41G 1/10 D22/109
4,959,908 A * 10/1990 Weyrauch ..... F41G 11/003 42/127
5,003,697 A * 4/1991 Hampton ..... F41G 1/383 42/129
5,887,375 A * 3/1999 Watson ..... G03B 29/00 42/106
7,121,037 B2 * 10/2006 Penney ..... F41G 11/001 42/126
7,900,390 B2 * 3/2011 Moody ..... F41A 23/08 42/71.01
7,954,273 B1 * 6/2011 Swan ..... F41G 1/35 42/117
8,104,218 B2 * 1/2012 McCann ..... F41G 1/033 42/144
8,220,946 B1 * 7/2012 Teetzel ..... F41G 11/003 89/200
8,468,735 B1 * 6/2013 Keng ..... F41G 1/08 42/148
8,726,562 B1 * 5/2014 Hoskisson ..... F41G 11/003 42/126
8,752,320 B2 * 6/2014 Masters ..... F41C 23/16 42/71.01
D713,921 S * 9/2014 Williams ..... D22/109
D715,393 S * 10/2014 Williams ..... D22/109
9,025,040 B2 * 5/2015 Thyssen ..... F41G 3/165 235/407
RE45,724 E * 10/2015 Dueck ..... F41G 1/02
9,417,034 B1 * 8/2016 Swan ..... F41G 11/007
9,441,915 B2 * 9/2016 Zimmer ..... F41G 11/001
D779,623 S * 2/2017 Geissele ..... D22/110
9,857,146 B1 * 1/2018 Shelton ..... F41G 11/003
10,030,935 B1 * 7/2018 Ding ..... F41G 1/17
10,254,084 B2 * 4/2019 Connolly ..... F41G 11/001
10,260,841 B2 * 4/2019 Kincel ..... F41C 27/00
10,337,837 B2 * 7/2019 Keller ..... F41G 1/16
10,495,417 B1 * 12/2019 Geissele ..... F41G 11/003
10,557,687 B2 * 2/2020 Teetzel ..... F41G 1/34
10,627,191 B1 * 4/2020 Fischer ..... F41G 11/008
10,627,192 B1 * 4/2020 Fischer ..... F41G 11/008
10,634,456 B1 * 4/2020 Fischer ..... F41G 11/003
10,670,374 B2 * 6/2020 Storch ..... F41C 27/00
D906,467 S * 12/2020 McCoy, II ..... G01C 9/28 D22/109
10,996,023 B2 * 5/2021 Roberts ..... F41C 27/00
11,060,815 B1 * 7/2021 Novak ..... F41C 27/00
11,067,365 B2 * 7/2021 Roberson ..... F41G 1/16
11,112,216 B1 * 9/2021 Fan ..... F41G 11/00
11,125,530 B2 * 9/2021 Kincel ..... F41C 23/16
11,199,378 B2 * 12/2021 LoRocco ..... F41G 1/545
11,237,379 B2 * 2/2022 McCoy, II ..... F41G 1/38
11,262,168 B1 * 3/2022 Morse ..... F41G 11/003
11,293,721 B2 * 4/2022 Ding ..... F41G 1/44
11,385,026 B2 * 7/2022 Roberson ..... F41G 11/001
11,435,163 B2 * 9/2022 Roberson ..... F41G 11/003
2002/0162267 A1 * 11/2002 Nelson ..... F41G 11/003 42/120
2005/0229465 A1 * 10/2005 Dextraze ..... F41G 11/003 42/85
2006/0026888 A1 * 2/2006 Cheng ..... F41G 11/004 42/146
2007/0033852 A1 * 2/2007 Adams ..... F41G 11/001 42/124
2007/0039225 A1 * 2/2007 Kallio ..... F41G 1/35 42/146
2008/0148619 A1 * 6/2008 Rogers ..... F41G 11/003 42/90
2009/0044439 A1 * 2/2009 Phillips ..... F41C 23/16 42/72
2009/0225557 A1 * 9/2009 Griffin ..... F41G 11/001 362/382
2010/0058640 A1 * 3/2010 Moore ..... F41G 1/36 42/114
2010/0162610 A1 * 7/2010 Moore ..... F41G 11/001 42/117
2011/0308130 A1 * 12/2011 Holmberg ..... F41G 1/473 356/4.01
2011/0310476 A1 * 12/2011 Russ ..... G02B 23/18 359/407
2012/0060402 A1 * 3/2012 Dueck ..... F41G 1/02 42/137
2012/0110886 A1 * 5/2012 Moore ..... F41G 1/35 42/114
2012/0180370 A1 * 7/2012 McKinley ..... F41G 11/003 42/146
2013/0008072 A1 * 1/2013 Chung ..... F41G 1/30 42/113
2013/0036650 A1 * 2/2013 Larue ..... F41G 11/003 42/148
2013/0185985 A1 * 7/2013 Ballard ..... F41G 11/003 42/148
2013/0240733 A1 * 9/2013 Plotsker ..... G02B 15/06 42/111
2013/0288743 A1 * 10/2013 Hunt ..... F41B 5/1492 29/434
2013/0318852 A1 * 12/2013 Teetzel ..... F41C 27/00 42/90
2014/0041273 A1 * 2/2014 Masters ..... F41C 23/16 42/71.01
2014/0096429 A1 * 4/2014 Sandler ..... F41G 11/003 42/124
2014/0123532 A1 * 5/2014 Russ ..... F41G 1/38 42/113
2014/0150324 A1 * 6/2014 Keng ..... F41G 1/30 42/118
2014/0157644 A1 * 6/2014 Jiminez ..... F41G 11/003 42/114
2014/0190062 A1 * 7/2014 Turner, Jr. ..... B23P 19/10 42/124
2014/0196349 A1 * 7/2014 Rogers ..... F41G 1/35 42/90
2014/0230306 A1 * 8/2014 Arachequesne ..... F41G 11/00 42/119
2014/0259854 A1 * 9/2014 Williams ..... F41G 11/003 42/124
2014/0360077 A1 * 12/2014 Miller ..... F41C 27/00 42/84
2015/0205066 A1 * 7/2015 Gibson ..... G02B 7/04 29/428
2015/0285584 A1 * 10/2015 Mayberry ..... F41G 11/003 42/71.01
2015/0292837 A1 * 10/2015 Cheng ..... F41G 1/38 42/123
2016/0102941 A1 * 4/2016 Brucker ..... F41G 1/033 42/148
2016/0209176 A1 * 7/2016 Zimmer ..... F41G 11/001
2016/0259374 A1 * 9/2016 Breiwa ..... F16B 1/00
2018/0073840 A1 * 3/2018 Kristoffersen ..... F41G 1/545
2018/0180386 A1 * 6/2018 Keller ..... F41G 1/04
2018/0195838 A1 * 7/2018 Storch ..... F41G 11/001
2018/0372448 A1 * 12/2018 Noskowicz ..... F41G 1/30
2019/0249958 A1 * 8/2019 Teetzel ..... F41G 3/12
2019/0277605 A1 * 9/2019 Geissele ..... F41G 11/003
2019/0368840 A1 * 12/2019 Banes ..... F41G 11/003
2020/0011642 A1 * 1/2020 Ma ..... F41G 11/004
2020/0025520 A1 * 1/2020 Niswander ..... F41G 11/00
2020/0025522 A1 * 1/2020 Zimmer ..... F41G 11/001

(56) References Cited

U.S. PATENT DOCUMENTS

| | | | | |
|---|---|---|---|---|
| 2020/0041890 | A1* | 2/2020 | Peel | F41J 5/10 |
| 2020/0064102 | A1* | 2/2020 | Galli | F41G 1/35 |
| 2020/0132414 | A1* | 4/2020 | Shelton | F41G 11/003 |
| 2020/0191232 | A1* | 6/2020 | Wagner | F16F 15/127 |
| 2020/0208946 | A1* | 7/2020 | Cahill | F41G 11/001 |
| 2020/0271422 | A1* | 8/2020 | Ramirez | F41G 11/003 |
| 2020/0272044 | A1* | 8/2020 | Walker | F41G 11/003 |
| 2021/0254923 | A1* | 8/2021 | Summers | F41B 5/1403 |
| 2021/0262766 | A1* | 8/2021 | Roberson | F41G 11/001 |
| 2021/0372736 | A1* | 12/2021 | Zhou | F21V 21/0885 |
| 2021/0372739 | A1* | 12/2021 | Nielsen | F41G 11/003 |
| 2022/0049929 | A1* | 2/2022 | Chen | F41G 1/44 |
| 2022/0074709 | A1* | 3/2022 | Bellah | F41G 3/06 |
| 2022/0113114 | A1* | 4/2022 | Humphries | F41G 1/01 |

OTHER PUBLICATIONS

Badger Ordnance Figures https://s.yimg.com/aah/optacticalgear/badger-ordnance-condition-one-modular-mount-r-24.jpg[Sep. 27, 2022 9:43:56 PM] (Year: 22).*

Andraž Gradišnik, "Combined use of a riflescope and a red dot sight," Opticstradeblog, https://www.optics-trade.eu/blog/combined-use-of-a-riflescope-and-a-red-dot-sight/, Published Apr. 19, 2019, Accessed May 28, 2020.

Badger Ordnance, "C.O.M.M. Condition One Modular Mount," Badger Ordinance 2019 Catalog, Published 2019.

* cited by examiner

FIREARM OPTIC ASSEMBLY

CROSS-REFERENCE TO RELATED APPLICATION

This application is a Continuation of U.S. patent application Ser. No. 17/745,944 filed on May 17, 2022, entitled "FIREARM OPTIC ASSEMBLY," which is a Continuation of U.S. patent application Ser. No. 16/990,615 filed on Aug. 11, 2020 now issued as U.S. Pat. No. 11,365,954, entitled "FIREARM OPTIC ASSEMBLY," which claims the benefit of U.S. Provisional Patent Application No. 63/048,218 filed on Jul. 6, 2020, entitled "CONDITION ONE MODULAR MOUNT," which are hereby incorporated by reference in their entirety for all that is taught and disclosed therein.

FIELD OF THE INVENTION

The present invention relates to firearms, and more particularly to a firearm optic assembly that enables removable attaching of multiple accessories to a firearm in multiple user-selectable locations.

BACKGROUND OF THE INVENTION

The attaching of two different types of sights to firearms is desirable for providing optimum sighting optics for both close and long-range engagements, as well as providing a degree of redundancy in the event one of the sights becomes damaged or otherwise inoperable. The combination of a high magnification rifle scope and a red dot sight is popular with armed forces and law enforcement officers, and is increasingly popular with hunters also. High magnification riflescopes enable accurate shots at long distances, and red dot sights, which typically lack magnification, enable rapid target acquisition at close range.

Several different prior art approaches have been used to enable the attachment of multiple sights to a firearm. One example uses a fixed power optic mounted on top of the rifle, like the Advanced Combat Optical Gunsight (ACOG) manufactured by Trijicon of Wixom, MI, but with the addition of using a red dot sight that is mounted on top of the ACOG or on an angled mount attached to the receiver or forend of the rifle. The other configuration employs a 1-4× variable magnification sight with a red dot sight mounted on top of the variable magnification sight or on an angled mount attached to the receiver or forend of the rifle.

An example of an angled mount used to attach a red dot sight to the forend of a rifle is the Condition One Modular Mount (COMM) manufactured by Badger Ordnance of N. Kansas City, MO. The COMM uses a J arm angled mount with a protrusion that is received in one of several pockets in the body of the COMM. Although the intention of the interface between the protrusion on the J arm and pockets is to enable removal of the protrusion from one pocket and insertion into another pocket as desired by the user, it has been found in practice that the total taper of 1° of the protrusion in combination with an anodized aluminum coating applied to the J arm and body can cause the protrusion to become permanently wedged in a pocket after the securing bolts have been tightened down.

Therefore, a need exists for a new and improved firearm optic assembly that enables the removable attaching of multiple accessories to a firearm in multiple user-selectable locations. In this regard, the various embodiments of the present invention substantially fulfill at least some of these needs. In this respect, the firearm optic assembly according to the present invention substantially departs from the conventional concepts and designs of the prior art, and in doing so provides an apparatus primarily developed for the purpose of enabling the removable attaching of multiple accessories to a firearm in multiple user-selectable locations.

SUMMARY OF THE INVENTION

The present invention provides an improved firearm optic assembly, and overcomes the above-mentioned disadvantages and drawbacks of the prior art. As such, the general purpose of the present invention, which will be described subsequently in greater detail, is to provide an improved firearm optic assembly that has all the advantages of the prior art mentioned above.

To attain this, the preferred embodiment of the present invention essentially comprises a body, the body having a first mounting facility configured to removably connect the body to the firearm, the body having a first receptacle configured to receive a first accessory, the body having a second mounting facility configured to removably receive a second mount portion associated with a second accessory offset from the medial plane, the second mounting facility including a pocket defined by one of the body and the second mount portion, the second mounting facility including a protrusion on the other of the body and the second mount portion, the protrusion being configured to be slidably or loosely received in the pocket, the protrusion having a free end and an opposed base end, the second mounting facility having an alignment facility including flared surfaces at the base end, and the flared surfaces being on opposing sides of the protrusion. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
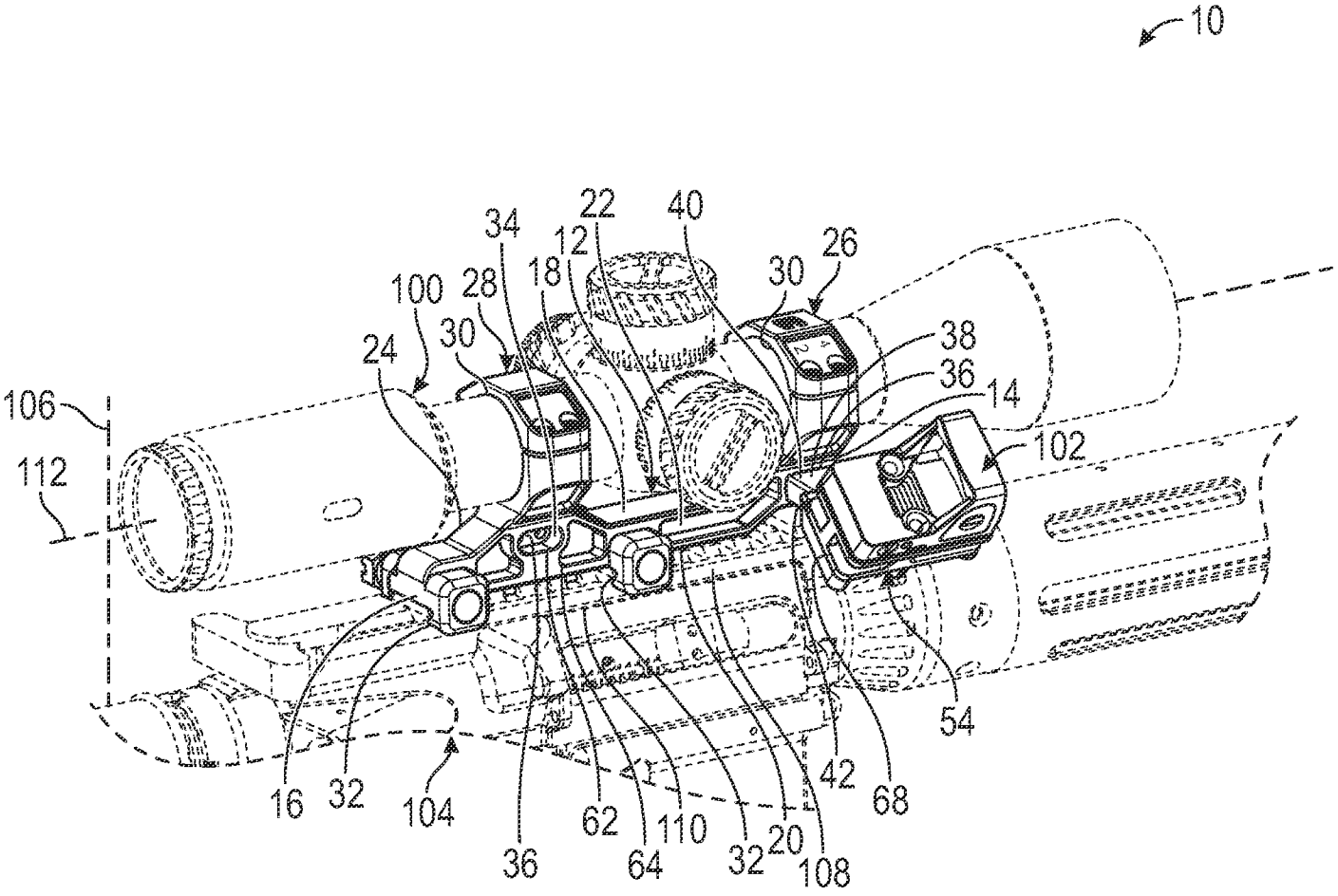
FIG. 1 is a rear isometric view of the current embodiment of a firearm optic assembly constructed in accordance with the principles of the present invention in use attaching a telescopic sight and a red dot sight to a rifle.
Figure 2:
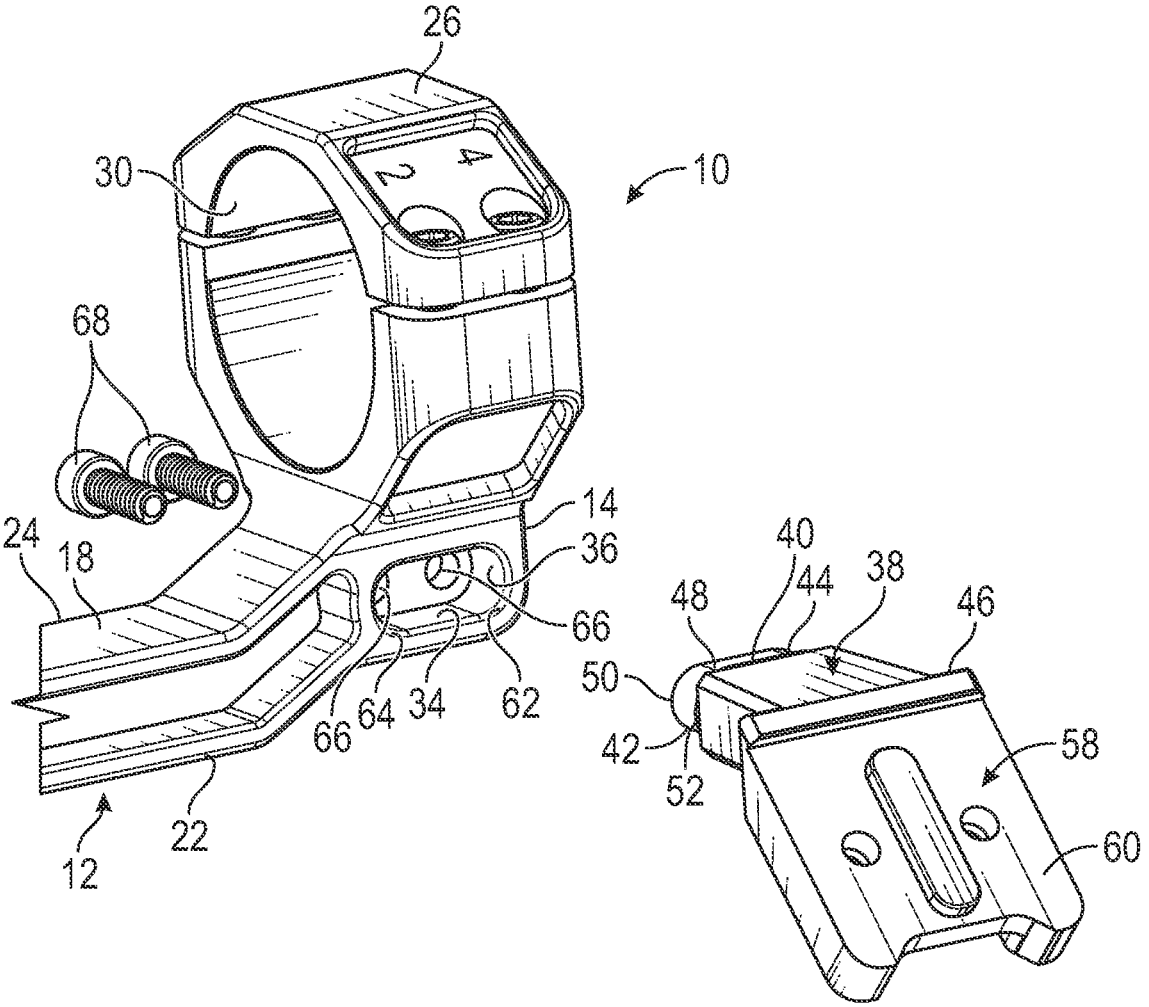
FIG. 2 is an exploded enlarged partial view of the firearm optic assembly of FIG. 1.
Figure 3:
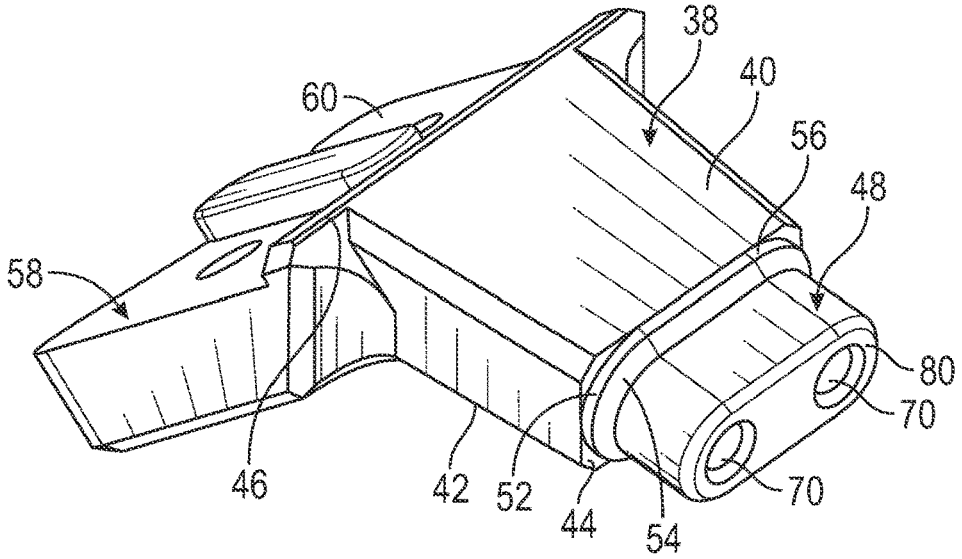
FIG. 3 is a front view of the second mount portion of the firearm optic assembly of FIG. 1.
Figure 4:
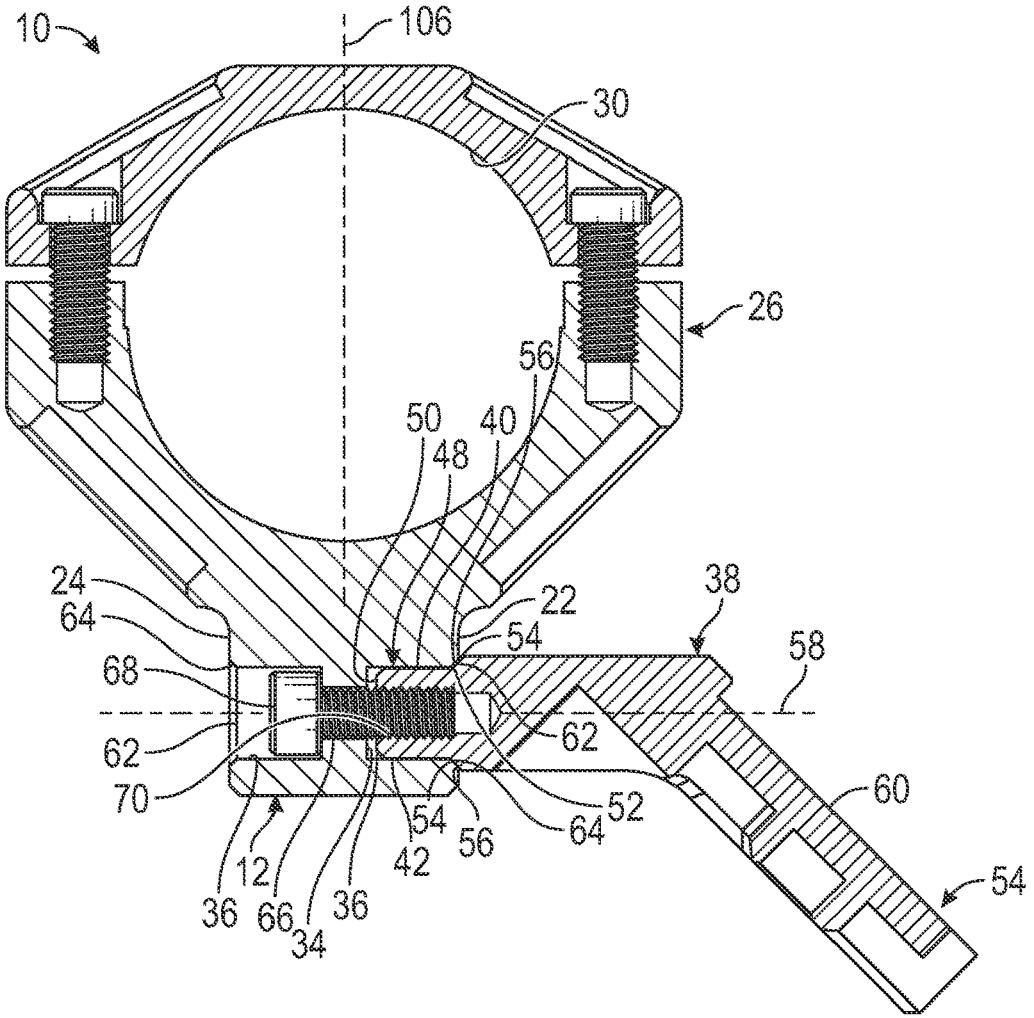
FIG. 4 is a rear sectional view of the firearm optic assembly of FIG. 1.
Figure 5:
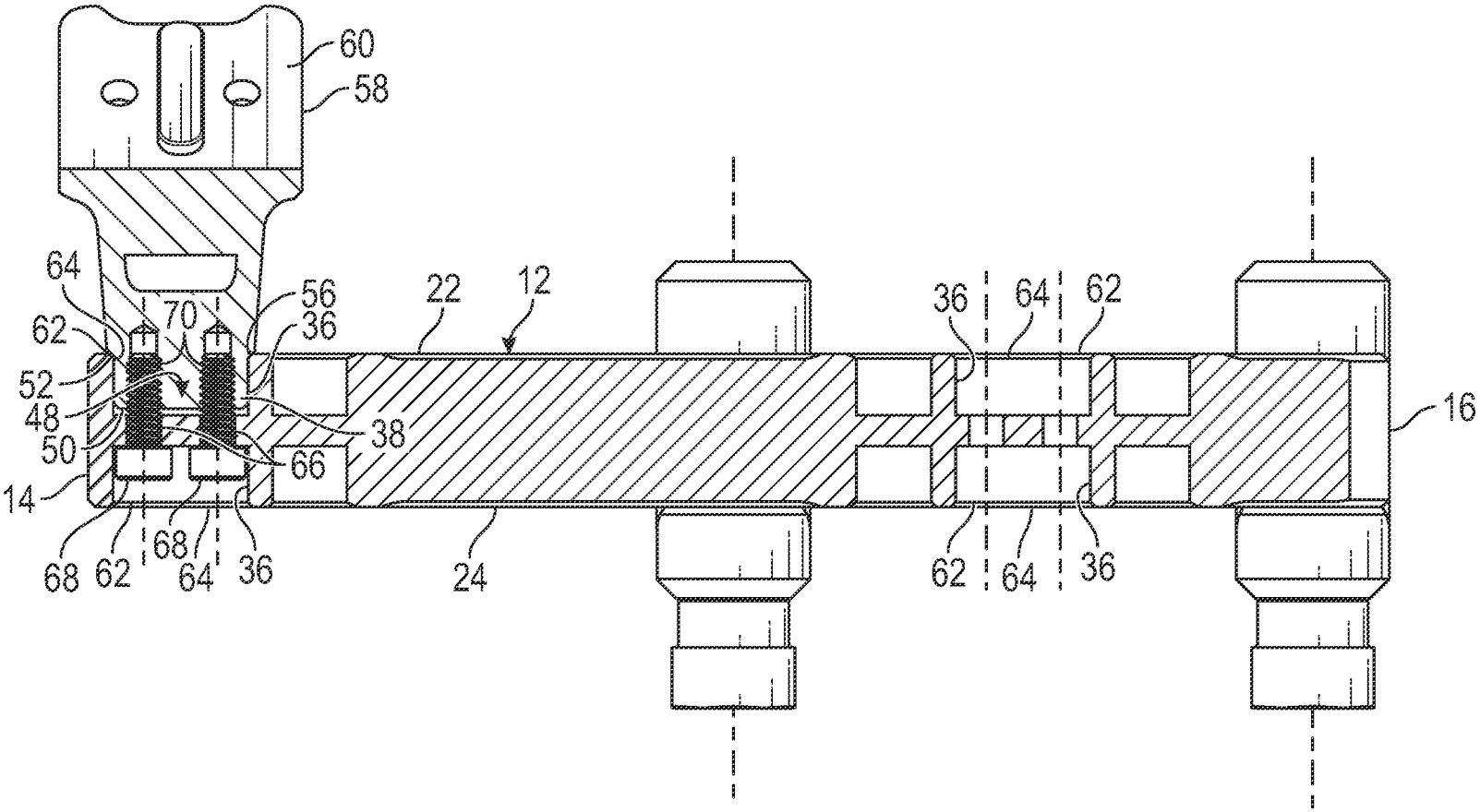
FIG. 5 is a side sectional view of the firearm optic assembly of FIG. 1.

An embodiment of the firearm optic assembly of the present invention is shown and generally designated by the reference numeral 10.

FIG. 1-5 illustrate the improved firearm optic assembly 10 of the present invention. More particularly, FIG. 1 shows the firearm optic assembly in use attaching a first sight (a telescopic, magnifying sight 100) and a second sight (a red dot non-magnifying sight 102) to a rifle 104 that defines a vertical medial plane 106. The first sight has an optical axis 112 in the vertical medial plane. The firearm optic assembly has a body 12 having a front 14, rear 16, top 18, bottom 20, right side 22, and left side 24. The top of the body includes a forward scope ring 26 and a rear scope ring 28. The forward and rear scope rings each define first receptacles 30 that receive and retain a first accessory (the telescopic sight). The first receptacles are aligned with the vertical medial plane. The bottom of the body includes a first mounting facility 32. The first mounting facility enables the firearm optic assembly to be removably connected to a Picatinny rail 108 on the top 110 of the rifle. The right and left sides of the body define a second mounting facility 34 in the form of four pockets 36. The pockets are distributed such that two pockets are on the left and right sides below the forward scope ring and two pockets are on the left and right sides below the rear scope ring. The pockets are all identical in size and shape.

A second mount portion 38 has a top 40, a bottom 42, front 44, and rear 46. The front includes a protrusion 48 having a free end 50 and an opposed base end 52. The protrusion is configured to be slidably or loosely received in any of the pockets 36 of the second mounting facility 34. The protrusion has an alignment facility 54 including flared surfaces 56 at the base end. The alignment facility includes opposed parallel straight elements (the top and bottom of the protrusion in the current embodiment) The flared surfaces are chamfers on opposing sides of the protrusion (the top and bottom of the protrusion in the current embodiment). The flared surfaces are each at an acute angle to an axis 58 defined by the length of the protrusion. The rear of the second mount portion includes a third mounting facility 58. The third mounting facility is configured to removably receive a second accessory (the red dot sight 102). The third mounting facility as a mounting surface 60 angled with respect to perpendicular to the vertical medial plane 106 such that the second accessory is offset from the vertical medial plane. In the current embodiment, the angle is between 15°-75°, more preferably between 30°-60°, and with 45° being most preferred because there are many 45° chamfers that make it most practical to machine third mounting facility at a 45° angle. Each of the pockets has a mouth 62, and each mouth has a flared surface 64 configured to align with the flared surfaces of the protrusion.

Each of the two pairs of pockets 36 on the right and left sides 22, 24 of the body 12 below the forward and rear scope rings 26, 28 (or which could be located anywhere else along right and left sides 22, 24) includes a pair of clearance holes 66 enabling communication between a pair of pockets. The clearance holes are configured to receive a pair of threaded fasteners 68. The free end 50 of the protrusion 48 includes a pair of threaded holes 70 that receive the threaded fasteners. The threaded fasteners releasably secure the protrusion within the selected pocket despite the protrusion being slidably or loosely received in the pocket. The protrusion can be easily removed from the selected pocket once the threaded fasteners are disengaged from the pair of threaded holes in the free end of the protrusion. The protrusion can then be moved to a different pocket and releasably secured again with the threaded fasteners. The four pockets provide four mounting points for the second accessory, both left, right, fore, and aft to suit a wide range of user needs.

In use, the user releasably secures the body 12 to the Picatinny rail 108 of the rifle 104, mounts telescopic sight 100 within the forward and rear scope rings 26, 28, attaches the third mounting facility 54 to any of the four pockets 36 using the threaded fasteners 68, and attaches the red dot sight 102 to the mounting surface 60 of the third mounting facility 54. The user then uses the telescopic sight to engage medium and long-range targets and the red dot sight to engage short-range targets. The red dot sight can also be used in the event the telescopic sight becomes damaged or malfunctions. The user switches between the two sights by tilting the rifle 45°. The firearm optic assembly is suitable for a variety of applications, including military, law enforcement, and hunting.

While a current embodiment of a firearm optic assembly has been described in detail, it should be apparent that modifications and variations thereto are possible, all of which fall within the true spirit and scope of the invention. Although rifles have been disclosed, the firearm optic assembly is also suitable for use with shotguns, light and medium machine guns, and other firearms. Furthermore, although attaching a red dot sight to the third mounting facility has been disclosed, a variety of other accessories can be attached to the third mounting facility, including lights and laser sights. In addition, although use of a single second mount portion with a single pair of pockets has been disclosed, an additional second mount portion can be installed in the second pair of pockets. It should also be appreciated that the second mounting facility can define a pocket and the body can include four protrusions arranged in pairs below the forward and rear scope rings with corresponding changes to the locations of the clearance and threaded holes to enable the use of the threaded fasteners. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A mount for attaching multiple accessories to a firearm defining a vertical medial plane, the mount comprising:

a body;

the body having a first mounting facility configured to removably connect the body to the firearm;

the body having a first receptacle configured to receive a first accessory;

the body having a second mounting facility configured to removably receive a second mount portion associated with a second accessory offset from the vertical medial plane;

the second mounting facility including a pocket defined by the body, the pocket having a flared opening;

a second mount portion including a protrusion having a tapered surface configured to be received in the flared opening;

the protrusion defining a protrusion axis;

the tapered surface being offset with respect to the protrusion axis by an angle of 15-75 degrees; and the tapered surface being tapered with a narrower dimension toward the free end than away from the free end such that insertion and extraction of the protrusion along the insertion axis is facilitated.

2. The mount of claim 1 wherein the body has a third mounting facility configured to removably receive the second accessory.

3. The mount of claim 2 wherein the third mounting facility is configured to removably receive a sight.

4. The mount of claim 1 wherein the first receptacle is aligned with the vertical medial plane.

5. The mount of claim 1 including a hole associated with the pocket and configured to receive a threaded fastener, and a threaded hole configured to receive the threaded fastener on the protrusion.

6. The mount of claim 5 wherein the hole associated with the pocket is surrounded by the flared opening.

7. The mount of claim 5 wherein the tapered surface of the protrusion surrounds the threaded hole.

8. The mount of claim 1 wherein the protrusion is configured to be loosely received in the pocket.

9. The mount of claim 1 wherein the pocket has a mouth, and wherein the mouth has a flared surface configured to align with the tapered surface of the protrusion.

10. The mount of claim 1 wherein the flared surface is a chamfer.

11. The mount of claim 1 wherein flared opening and the tapered surface are at an acute angle to an axis defined by the protrusion.

12. The mount of claim 1 including a fastener securing the tapered surface against the flared opening.

13. The mount of claim 1 wherein the flared opening and tapered surface each include planar surfaces that are each offset 45 degrees from the vertical medial plane.

* * * * *